US007080838B2

(12) United States Patent
Cohen

(10) Patent No.: US 7,080,838 B2
(45) Date of Patent: Jul. 25, 2006

(54) METHOD AND APPARATUS FOR A DICE GAME

(76) Inventor: Joycelyn B. Cohen, 10990-B Camino Ruiz, San Diego, CA (US) 92126

( * ) Notice: Subject to any disclaimer, the term of this patent is extended or adjusted under 35 U.S.C. 154(b) by 261 days.

(21) Appl. No.: 10/689,798

(22) Filed: Oct. 20, 2003

(65) Prior Publication Data

US 2005/0082757 A1 Apr. 21, 2005

(51) Int. Cl.
*A63F 3/00* (2006.01)

(52) U.S. Cl. ..... 273/274; 273/146

(58) Field of Classification Search ..... 273/274, 273/146, 243, 139, 309; 463/16, 17
See application file for complete search history.

(56) References Cited

U.S. PATENT DOCUMENTS 1,526,092 A * 2/1925 Robertson ..... 273/247
1,669,470 A 5/1928 Jasper
1,747,065 A * 2/1930 Elliott ..... 273/247
2,664,292 A 12/1953 Lee
4,247,114 A 1/1981 Carroll
4,989,879 A * 2/1991 Nigh ..... 273/247
5,308,081 A 5/1994 Bartle
5,413,351 A 5/1995 Franklin
5,662,330 A 9/1997 Spears
5,695,193 A 12/1997 Cheung
5,806,847 A 9/1998 White et al.
6,209,874 B1 4/2001 Jones
6,554,281 B1 * 4/2003 Flannery ..... 273/274
2005/0161879 A1 * 7/2005 Scheb et al. ..... 273/138.1

* cited by examiner

*Primary Examiner*—William M. Pierce
(74) *Attorney, Agent, or Firm*—Donn K. Harms

(57) ABSTRACT

This invention consists of a unique entertaining board game where the total value of two dice of different colors or with a recognizable difference, one designating possible single value numerals, (1 through 6), and the other values of possible numerals, times ten, (10 through 60), are added together, creating a strictly unique sequence of thirty-six numerals. The object of the game is to have a fixed or moveable designated numeral to determine the beating of the ladder by the player rolling the dice with a score of the designated numeral or greater, while the other players bet that the score will be either higher or lower than the designated number. A bank pays the winnings and takes in the losses.

20 Claims, 2 Drawing Sheets

METHOD AND APPARATUS FOR A DICE GAME

FIELD OF THE INVENTION

This invention relates to the field of gaming and to dice games in general where one or more players gather around a table at a commercial establishment or at a private location to play a game. More particularly the present invention relates to a dice game called "Beat the Ladder" in which a number of players bet on whether the player throwing the dice will have a total on the dice either above or below a given designated numeral on a board called the "Ladder Board."

BACKGROUND OF THE INVENTION

The present invention is directed toward a board game and more particularly toward a game of chance employing dice that is intended to be played in a gambling casino but which is also practical as a game for adults to be played in private, or a game to be played by the whole family as a parlor game.

With the opening of gambling casinos on the east coast of the United States and more particularly in Atlantic City, N.J., there has recently been a renewed interest in casino type games. A popular game in casinos is craps, which is a game of chance played with two dice. While craps is an extremely exciting game, the rules thereof are relatively complex. As a result, only experienced gamblers tend to play and amateurs normally shy away. Numerous dice games are known in the prior art. Dice games are predominantly games of chance in which winning or losing depends on the random chance of certain dice combinations being turned rather than the skill of the player.

There has, therefore, been a need for more games of chance which have the excitement of craps but that are simpler to play and understand, which inexperienced gamblers can play as well as families and friends at home.

REFERENCES CITED

U.S. Pat. No. 1,669,470 of Ida Jasper describes a game where a pair of dice are employed to denote the placement or removal of chips upon or from areas on a game board. At the commencement of the game, each player is given a certain number of chips, the board being clear of chips. The players throw the dice in turn and after each throw a player places a chip upon the area whose indicating numeral is produced by adding together the figures on the upturned faces of the two dice. A player throwing a "seven" is not required to ante a chip. The throwing of the dice by the respective players in turn continues until there is at least one chip in each area. This concludes the first or "ante" stage of the game.

Following is the "dividend" stage of the game, that is to say, wherein the players remove the chips from the board according to the upturned numbers of the dice or indicators. The dice are thrown in turn by the players as before, but instead of "anteing" a chip in the area corresponding to the number thrown, the player removes all chips from the area corresponding to the aggregate number appearing on the upturned faces of the dice. However, should a player throw a "seven" he is entitled to remove all of the chips from the board.

This patent does not suggest the particular board game having a fixed or moveable designated numeral to determine the beating of the ladder by the player rolling the dice with a score of a unique sequence of numerals being greater than the designated numeral, while the other players bet that the score will be either higher or lower than the designated number.

U.S. Pat. No. 2,664,292 of William D. Lee teaches of an invention that relates generally to a game of the character in which a game board is included. More specifically, the invention relates to a game of chance wherein is provided the combination of a game board or combination sheet divided into a plurality of spaces, the spaces carrying a designating character or combination of two such characters, as the case may be. The said board provides for a variety of selections to be placed thereon by the various players and counting elements manipulated by a designated player or banker to correspond in number to a designating character on the board.

This does not have a number of players betting on whether the player throwing the dice will have a total on the dice either above or below a given designated numeral on a board.

U.S. Pat. No. 4,247,114 (Carroll) discloses a playing surface which includes a center area surrounded by a wall within which are intended to be thrown three dice, each having a color different from the other two. A first betting area adjacent to the center area is identified by the color of one of the dice and is divided into six spaces corresponding to the six faces of the one die. A second betting area also located adjacent to the center area is arranged similar to the first betting area but is identified by a color which is the same as the color of one of the other dice. Other areas are provided for betting evens or odds or doubles. Pluralities of betting chips are adapted to be selectively placed on the various betting areas.

This is another dice game that does not have a number of players betting on whether the player throwing the dice will have a total on the dice either above or below a given designated numeral on a board.

U.S. Pat. No. 5,308,081 of Richard J. Bartle additionally describes a method of playing the betting game including providing a playing surface, betting tokens and dice. The playing surface has three types of betting zones demarcated on it. The first type of betting zone has a representation corresponding to a result obtainable from the throw of one dice. The second type of betting zone has a representation corresponding to a result obtainable from the throw of two dice or of the second dice with reference to the first dice. The third type of betting zone has a representation corresponding to a result obtainable from the throw of three dice. Bets are placed sequentially on the respective betting zones before each of the three dice is thrown.

This is still another dice game that does not have a number of players betting on whether the player throwing the dice will have a total on the dice either above or below a given designated numeral on a board.

U.S. Pat. No. 5,662,330 of Richard L. Spears teaches of a gaming system and method comprising a flat craps table constructed and adapted for a set of five dice to be rolled thereupon. The patent discloses a set of five dice and betting indicia on the table defining betting spaces, the betting spaces respectively being identifiable as winning spaces if, respectively, the dice, when rolled and the number of spots thereon counted and totaled, define specific totals or sets of numbers.

This dice game uses a set of five dice rather than the two dice of varying appearance representing a strictly unique sequence of numbers.

U.S. Pat. No. 5,695,193 of Richard C. Cheung describes a dice game called "House 6" in which the object of the games is to roll a combination containing the highest pair and the highest third dice value. Each player plays against the other players or against a designated player "Dealer". Each player and/or dealer rolls three dice and then has the option of accepting the result of that roll or rolling one more time. All combinations are compared to that of each player in turn and the combination with the higher value wins. If there is a Dealer or Player Dealer, then the dealer's dice combination is compared against that of each player in succession to determine the winner between each player and the dealer.

This is still another dice game that does not have a number of players betting on whether the player throwing the dice will have a total on the dice either above or below a given designated numeral on a board and this dice game uses a set of three dice rather than the two dice of varying appearance representing a strictly unique sequence of numbers U.S. Pat. No. 5,806,847 of Roger L. White et al. discloses a game of chance having a playing surface including a plurality of betting areas. The betting areas have a plurality of betting squares for wagering upon a selected result produced by a random result selector such as dice. In one embodiment, the random result selector comprises a plurality of dice having a plurality of faces, each face embossed with either a number or a special symbol. Each betting square contains result indicators that correspond to a selected one of the plurality of results. In addition, each betting square contains a payoff indicator that displays the payoff associated with a winning wager on the selected betting square. A single random result leads to a final and unequivocal outcome of all bets made on all betting squares. The playing surface is adapted to be placed over existing casino equipment or may be used alone.

This patent does not suggest the particular board game having a fixed or moveable designated numeral to determine the beating of the ladder by the player rolling the dice with a score of a unique sequence of numerals being greater than the designated numeral, U.S. Pat. No. 6,209,874 of Paul Jones describes a game where a player may make any of six types of wagers on the result of rolling three dice. A first type of wager is on the face-up sides of the selected two of the dice indicating a selected number. A second type of wager is on the face-up side of a selected one of the dice indicating a selected number. A third type of wager is on the face-up side of a selected one of the dice indicating a number that is alternatively higher or lower than numbers indicated by the other two dice. A fourth type of wager is on the face up sides of the dice each indicating a number selected by the player. A fifth type of wager is on the face-up sides of the dice indicating numbers having a sum, which is a selected, total number. A sixth type of wager is on the sum of numbers indicated by the face-up sides of the three dice being alternatively an odd number or an even number.

In the game of "Beat the Ladder" the players and the individual throwing the dice only have the opportunity to bet above or below a designated numeral, while the individual throwing the dice has the opportunity to receive more than the amount of the bet by having made other combinations of numerals on the dice.

None of the foregoing prior art teaches or suggests the particular board game having a fixed or moveable designated numeral to determine the beating of the ladder by the player rolling the dice with a score of a unique sequence of numerals being greater than a designated numeral, while the other players bet that the score will be either higher or lower than the designated numeral.

SUMMARY OF THE INVENTION

The preferred embodiment of this invention consists of a unique entertaining board game where the total value of two dice with a recognizable difference, one designating possible single value numerals, (1 through 6), and the other values of possible numerals, times ten, (10 through 60), are added together, creating a strictly unique sequence of 36 numerals. In the preferred embodiment, the board or playing surface on which this game is printed is rectangular in shape with two players on each side and a player on one end. It must be understood that the board or playing surface may be any geometric shape as well as a half circle and played by one or more players while still remaining within the intended scope of this patent.

The board or playing surface has a ladder design printed on it with the possible unique sequence of numerals within the support structure of the ladder design. Each numeral of the unique sequence of numerals will be printed adjacent to each rung of the ladder on both of the supporting structures of the ladder. The numerals may be printed in the same plane on the ladder structure or with one set of the unique sequence of numerals printed upside down as shown in the drawing of the preferred embodiment of the invention making it easier to read by those players at the top of the board.

A fixed or moveable designated numeral, as the designated numeral forty-five shown in the preferred embodiment, is used to determine the beating of the ladder, or winning a turn at the dice. Alternate numerals may be chosen for the changing of the odds of wining or losing the turn when throwing the dice by supplying a moveable numeral designator.

One or more individuals may play the game of "Beat the Ladder". The game can be played with a non-playing banker, a playing banker, or an open bank pot within the elliptical design in the center of the board.

To play the preferred embodiment of the "Beat the Ladder" game a player is chosen to be the first one to roll the pair of dice by rolling for the highest set of numerals. After the first individual rolls the pair of dice, the total value of the pair of dice is established. The dice with the single value numerals, (1 through 6), and the dice with the other values of possible numerals, times ten, (10 through 60), are added together. The individual rolling the pair of dice is always playing to "Beat the Ladder" or achieve a total designated numeral forty-five or above by placing the bet on the positive (P+). Other players at the table can either bet positive (P+) above the designated numeral forty-five or negative (−) below the designated numeral forty-five, on what the individual rolling the pair of dice will have as a total. This total will be the first indicator of whether the other players have won their bet. If the individual rolling the dice has a total of the designated numeral forty-five or more, the individual will win the equivalent value of the bet. The individual rolling the pair of dice can also win the equivalent value of the bet by rolling the pairs, 11, 22, 33 and 44. When the individual rolling the pair of dice has any of these combinations of numerals, all other players automatically lose their bets. If the individual does not have any of these combinations and the other players have made their bet on the correct total being either P+ or P− they win the equivalent value to their bet. The game may be played where the individual rolling the dice can take as many turns as desired at rolling the dice, or there may be a designated maximum number of times the individual may roll the dice or each player having only one turn at rolling the dice, all being within the scope of the patent on this game.

At the start of the game each player will have a given number of betting chips. When the game is played with a non-playing banker, the banker pays all winnings and takes in the losses and supervises the playing activities. When the game is played with a playing banker, the banker may make bets from his betting chips and take turns at rolling the dice, as well as pay all winnings and take in the losses from a bank pot. When the game is played with an open bank pot, a number of betting chips are placed within the ellipse in the center of the board or to one side to supply winnings and receive losses.

To play the first alternate embodiment of the "Beat the Ladder" game a player is chosen to be the first player to roll the pair of dice by rolling for the highest number. After the individual rolls the pair of dice, the total value of the pair of dice is established. The dice with the single value numerals, (1 through 6), and the dice with the other values of possible numerals, times ten, (10 through 60), are added together. The individual rolling the pair of dice is always playing to "Beat the Ladder" or achieve a total of the designated numeral forty-five or above by placing the bet on the positive (P+). Other players at the table can either bet positive (P+) above the designated numeral forty-five or negative (N−) below the designated numeral forty-five on what the individual rolling the pair of dice will have as a total. This total will be the first indicator of whether the other players have won their bet. If the individual rolling the dice has a total of the designated numeral forty-five or more, the individual will win the equivalent value of the bet. The individual rolling the pair of dice can also win the equivalent value of the bet by rolling the combinations, 11, 22, 33 and 44. When the individual rolling the pair of dice has any of these combinations of numerals, all other players automatically lose their bets.

At this point the game differs by letting the individual rolling the dice have a second turn or "push" and roll the dice a second time. On the second roll of the dice the individual may keep his bet or increase it. If the individual gets above the designated numeral forty-five, he wins his bet, and if he gets any of the combinations 11, 22, 33, or 44 for a second time, his winnings may be increased by a given value or increased depending upon the value of the pair of numerals. Other players may bet on the second roll of the dice as they did the first.

If the individual does not have any of these combinations and the other players have made their bet on the correct total being either P+ or N−, they win equivalent value to their bet. The game may be played where the individual rolling the dice can take as many turns as he desires at rolling the dice or there may be a designated maximum number of times the individual may roll the dice or each player having only one turn at rolling the dice, all being within the scope of the patent on this game.

At the start of the game each player will have a given number of betting chips. When the game is played with a non-playing banker, the banker pays all winnings and takes in the losses, along with supervising the playing activities. When the game is played with a playing banker, the banker may make bets from the banker's betting chips and take turns at rolling the dice, along with paying all winnings and taking in the losses from a bank pot. When the game is played with an open bank pot, a number of betting chips are placed within the ellipse in the center of the board or to one side to supply winnings and receive losses from losing players.

A third alternate embodiment of the invention consists of an adult version where the individual throwing the dice and the other players play "Beat the Ladder" and endeavor to keep their clothes on. Individuals bet positive or negative to see if the individual throwing the dice is going to "Beat the Ladder" or score 45 or above. If the individual throwing the dice does not "Beat the Ladder," 45 or above, the individual throwing the dice loses one item of clothing as well the players who bet positive.

The players who bet negative, 44 or below keep their clothes on. If the individual throwing dice beats the ladder or scores 45 or above, the players who bet negative, 44 or below lose one item of clothing of their choice. Players who bet positive 45 or above, will keep their clothing on as well as the individual throwing the dice.

If the individual throwing the dice throws a designated numeral which in the current preferred mode is forty-five or other designated numeral, the individual throwing the dice keeps his clothing on, and all the players who bet positive or negative will lose one item of their clothes.

If the individual throwing the dice throws one of the pairs 11, 22 or 33, the individual throwing the dice has to do whatever each player who bet negative asks him to do. Players who bet positive lose one item of clothing.

If the individual throwing the dice throws one of the pairs 44, 55 or 66, the individual throwing the dice has to do whatever each player who bet positive asks him to do. Players who bet negative lose one item of clothing The individual throwing the dice has to throw the dice at least once or can throw the dice as long as he wants, or can pass the dice to the next player in a clockwise direction, but players cannot pass their turn to throw the dice. The last player who remains with the most clothing on is the winner. To mark the bet each player may use any item of clothing of choice, but it has to be different from the previous players. This embodiment of the game of "Beat the Ladder" can be played between two or more players.

There has thus been outlined, rather broadly, the more important features of the invention in order that the detailed description thereof that follows may be better understood, and in order that the present contribution to the art may be better appreciated. As such, those skilled in the art will appreciate that the conception, upon which this disclosure is based, may readily be utilized as a basis for designing of other games, methods for playing other games and systems for carrying out the several features of the present invention. It is important, therefore, that the claims be regarded as including such equivalent construction insofar as they do not depart from the spirit and scope of the present invention.

THE OBJECTS OF THIS INVENTION

The object of this invention is to create a unique entertaining board game that may be played in casinos as well as in a private environment by families or friends.

Another object of this invention is to create an entertaining board game that uses dice as a means of activation.

Yet another object of this invention is to create an entertaining board game where the total value of two dice of different colors or with a recognizable difference, one designating possible single value numerals, (1 through 6), and the other designating values of possible numerals times ten, (10 through 60), are added together, creating a unique sequence of numerals.

A further object of this invention is to create a game with a board that has a ladder design having the possible unique sequence of numerals printed on the support structure adjacent to each rung of the ladder.

Still another object invention is to create a board game that has a fixed or moveable designated numeral, as the designated numeral forty-five is used in the preferred embodiment, to determine the beating of the ladder, or the changing of the odds of wining or losing the throw of the dice.

A final object of this invention is to create a unique entertaining board game that can be played in different ways.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
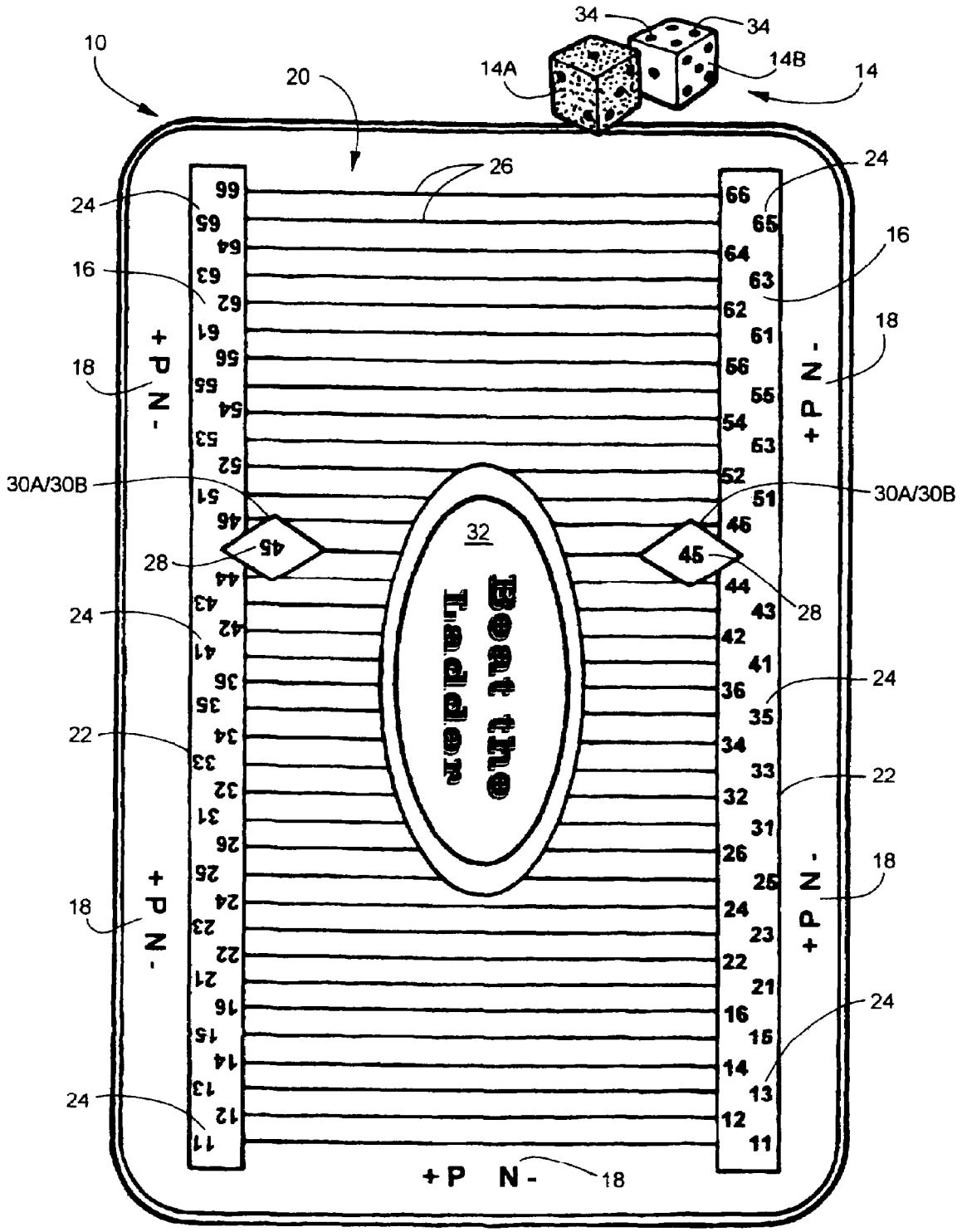
FIG. 1 depicts the layout of the game board for the game herein disclosed and described currently named "Beat the Ladder."
Figure 2:
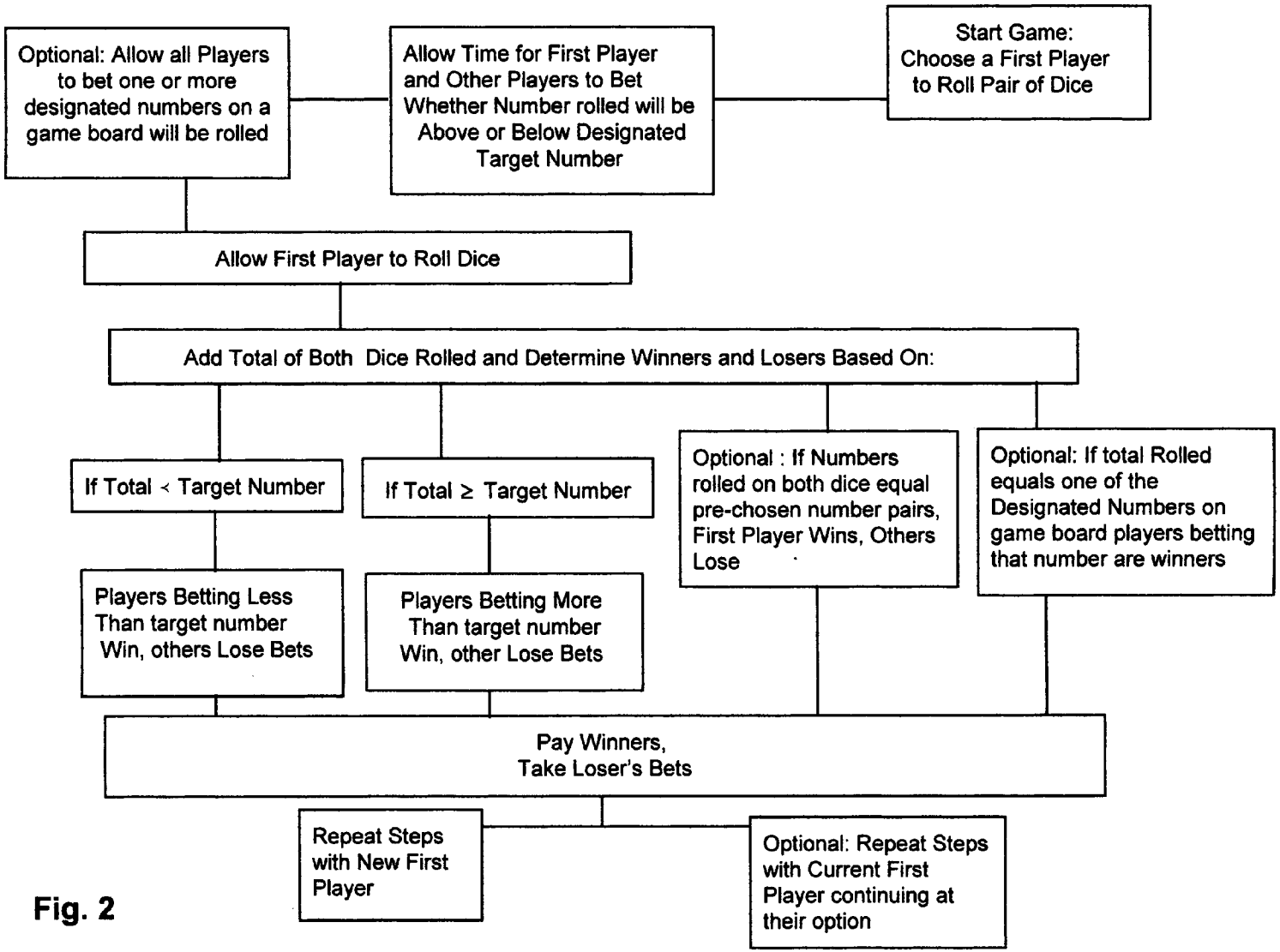
FIG. 2 is a flow chart of the various embodiments of the game.

Referring now to the drawings, wherein similar parts of the invention are identified by like reference numerals, there is seen in FIG. 1 the board or playing surface 12 of the "Beat the Ladder" board game 10. This invention consists of a unique entertaining board game where the total value of two dice 14 of different colors 14A and 14B or with some other easily visually recognizable difference, one designating possible single value numerals, (1 through 6), and the other with values of possible numerals, times ten, (10 through 60), are added together, creating a strictly unique sequence of thirty-six numerals 16. The board or playing surface 12 that this game is printed on of the "Beat the Ladder" board game 10 is rectangular in shape with two players position 18 on each side and one player position 18 on one end. It must be understood that the board or playing surface 12 may be any geometric shape as well as a half circle and played by one or more players while still remaining within the intended scope of this patent. Further, the game can be played without the board just using the dice 14 in a simpler version, however the board does provide an ease of use and aesthetic quality to the game 10 which is desirable.

The board or playing surface 12 in the current preferred mode has a ladder design 20 printed on it with the possible unique sequence of numerals 16 within the support structure 22 of the ladder design 20. Each single numeral 24 of the unique sequence of numerals 16 will be printed adjacent to each rung 26 of the ladder design 20 on both of the supporting structures 22. The unique set of numerals 16 may be printed in the same plane on the ladder structure 22 or with one set of the unique sequence of numerals 16 printed upside down as shown in the drawing of the board or playing surface 12 making it easier to read by those players at the top of the board.

A fixed or moveable designated numeral 28, which will be the target number is shown as the numeral forty-five depicted within the designated numeral identifier 30A in the preferred embodiment, is used to determine the beating of the ladder, or target number which determines winning a turn at the dice 14. Alternate designated numerals 28 may be chosen as the target number for the changing of the odds of wining or losing the turn when throwing the pair of dice 14 by supplying a moveable numeral designator 30B.

One or more individuals may play the game of "Beat the Ladder." The game can be played with a non-playing banker, a playing banker, or an open bank pot within the elliptical design 32 in the center of the board.

To play a first preferred embodiment of the "Beat the Ladder" game 10 a player is chosen to be the first one to roll the pair of dice 14 by rolling for the highest set of numerals indicated by the dots 34 on the pair of dice 14 or in some other agreeable fashion. After the first individual rolls the pair of dice 14, the total value of the pair of dice 14 is established. The dice 14A with the single value numerals, (1 through 6), and the dice 14B with the values of the numerals multiplied times ten, (10 through 60), are added together. The two dice 14 would be visually identifiable from each other with a means for visual identification such as color. The individual rolling the pair of dice 14 is always playing to "Beat the Ladder" or achieve a total sum of the two thrown dice which meets or exceeds the chosen target numeral of numeral forty-five or above by placing the bet on the positive (P+) of the player position 18. Of course variations on this target number to beat might be used to change the odds of the game 10; however, currently the numeral forty-five is the number which players attempt to exceed when rolling the both dice 14A and 14B.

Other players at the table can either bet on what the individual rolling the pair of dice 14 will yield as a total by placing their bet at the player position 18 on the positive (P+), for a number equal to or above designated numeral forty-five, or on the negative (−), for sums below the designated numeral forty-five. This total of the rolled dice 14 will be the first indicator of whether the other players have won their bets. If the playing individual rolling the pair of dice 14 has a total of the designated numeral forty-five or more, the individual will win the equivalent value of the bet. For increased payouts and options for the players, optionally they may also be allowed to bet on individual numbers shown as numerals 24. Since such a bet would be a long shot, the payback for a player betting an individual number would be significantly higher than for those just betting to exceed or be less than the target number. This option might be especially desirable in a casino setting where players like to bet long shots and casinos banking the game like the return on such bets.

During his roll, the player rolling the pair of dice 14 can also win the equivalent value of the amount he bets by rolling the designated combinations, 11, 22, 33 and 44. Of course these designated combinations might also be varied in other embodiments of the game 10 and such is anticipated; however, the noted combinations are the favored ones in the current preferred embodiment of play. When the individual rolling the pair of dice has any of these combinations of numerals, all other players automatically lose their bets. The rolling individual would be given the option to roll again. If the individual does not have any of these combinations and the other players have made their bets on the correct total being either P+ or P− at their player position 18, they win equivalent value to their bets depending on whether the rolling player exceeds the target number or not.

The game may be played where the individual rolling the pair of dice 14 can take as many turns as desired at rolling the pair of dice 14 or there may be a designated maximum number of times the individual may roll the pair of dice 14 or each player having only one turn at rolling the pair of dice 14, all being within the scope of the patent on this game 10. Further, all of the players may be required to take a turn rolling the dice 14 in a determined order or they may be allowed to skip turns. However, the preferred mode would require all to take their turn in order.

As noted above, in playing a first alternate preferred embodiment of the "Beat the Ladder" game 10, a player is chosen to be the first one to roll the pair of dice 14 by first rolling amongst the potential players to determine the player reaching the highest numeral of the two dice 14 or by some other agreeable fashion. After the chosen first player rolls the pair of dice 14, the total value of the pair of dice 14 is established. The dice with the single value numerals, (1 through 6), and the dice with the other values of possible numerals, times ten, (10 through 60), are added together. The individual rolling the pair of dice 14 has a goal to "Beat the Ladder" or achieve a total of the designated numeral forty-five or above by placing the bet on the positive (P+). Other players at the table can either bet positive (P+) above the designated numeral forty-five or negative (P−) below the designated numeral forty-five on what each individual rolling the pair of dice will have as a total. This total will be the first indicator of whether the other players have won their bet on that individual roll of the dice 14. If the current player rolling the dice 14 has a total of the designated target numeral forty-five or more, the individual will win the equivalent value of his bet.

The current player rolling the pair of dice 14 can also win the equivalent value of his bet by rolling a first numeral equaling the combinations, 11, 22, 33 and 44 on the first roll. When the individual rolling the pair of dice 14 has any of these combinations of numerals on the first roll, all other players automatically lose their bets. At this point the game 10 differs by letting the player rolling the dice 14 have a second turn or "push" and roll the dice 14 a second time. On the second roll of the dice the individual may maintain his bet from the first roll or increase it. On this second roll of the turn, if the individual gets above the designated numeral forty-five, he wins his bet, and if he gets any of the combinations 11, 22, 33, or 44 for a second time, his winnings may be increased by a larger given value or increased depending upon the value of the pair of numerals thrown. Other players may bet on the second roll of players' turn as they did the first.

On this second roll, if the player rolling the dice 14 does not have any of these combinations and the other players have made their bet on the correct total being either P+ or P−, they win equivalent value to their bet depending on the outcome of the roll. This embodiment of the game 10 may be played where the individual rolling the dice 14 can take as many turns as he desires at rolling the dice 14 or there may be a designated maximum number of times the individual may roll the dice subsequent to the first roll.

A third alternate preferred embodiment of the game 10 herein described, consists of an adult version of the game 10 where the individual throwing the dice 14 and the other players play "Beat the Ladder" and instead of betting with chips or money, they bet their clothing and play to keep their clothes on. Individual players betting on the first or subsequent roll by the rolling player, bet positive or negative to see if the individual throwing the dice is going to "Beat the Ladder" by beating the designated target number which currently is a numerical total of the two dice 14A and 14B which is 45 or above. If the individual throwing the dice does not "Beat the Ladder" by rolling a 45 or above, the individual throwing the dice loses one item of clothing. This loss of one piece of clothing would be the same as well for the players who bet positive. The players who bet negative, 44 or below keep their clothes on and optionally can be given chips for their win which can be substituted for clothing in subsequent rolls by themselves or other players. If the individual throwing dice beats the ladder or scores 45 or above, the players who bet negative, 44 or below lose one item of clothing of their choice. The rolling player and other players who bet positive 45 or above, will keep their clothing on as well as the individual throwing the dice. Optionally, they may be awarded a chip for a win which may be turned in on a losing roll later on.

In this adult version, much the same as the prior embodiments, if the individual throwing the dice 14 throws the exact target number which in the current mode is the total of the two dice 14 equaling the numeral forty-five, the individual throwing the dice keeps his clothing on, and all the players who bet positive or negative lose one item of their clothes which they had bet. This rule encourages the players to take their turn since they have an advantage over all other players if they roll the target number.

Optionally, in this adult version, if the individual throwing the dice 14 during his turn throws any one of the pairs 11, 22 or 33, the individual throwing the dice has to do a designated task each player who bet negative asks him to do. Players who bet positive lose one item of clothing. If the individual throwing the dice 14 throws one of the pairs 44, 55 or 66, the individual throwing the dice has to do whatever task each player who bet positive asks him to do. Players who bet negative would lose one item of clothing.

Also in this adult version, everyone playing must take their turn in order once the rolling player ceases his turn rolling the dice 14. If the players opt for it at the beginning of the game, the rolling player can throw the dice as long as he wants, or can pass the dice to the next player in a designated direction which in the current best mode is clockwise by convention. As noted, in this adult version, no player can pass his turn to throw the dice when it is his turn. Once all but one of the players are fully disrobed, the last player who remains with clothing still on is the winner. This embodiment of the game of "Beat the Ladder" can be played between two or more players.

While all of the fundamental characteristics and features of the present game invention have been described herein, with reference to particular embodiments thereof, a latitude of modification, various changes and substitutions are intended in the foregoing disclosure. It should be understood that any such substitutions, modifications, and variations may be made by those skilled in the art without departing from the spirit or scope of the invention. Consequently, all such modifications and variations are included within the scope of the invention.

Further, the purpose of the abstract of the disclosure herein is to enable the U.S. Patent and Trademark Office and the public in general, and especially practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Finally, while the present invention has been described herein with reference to particular embodiments thereof, a latitude of modifications, various changes and substitutions are intended in the foregoing disclosure, and will be appreciated that in some instance some features of the disclosed invention will be employed without a corresponding use of other features and/or in different combinations with other features without departing from the scope of the invention as set forth in the following claims.

What is claimed is:

1. A Method for playing a game having a game board and having a pair of dice, said pair of dice having first die with the numerals one through six and having a second die, with the numerals one through six, said second die visually identifiable from the first die, indicia on said game board designating individual board numerals 11 through 66, indicia on said game board designating a target number, indicia on said game board designating a first point equal to or exceeding said target number, and indicia on said game board designating a second point less than said target number:

(a) choosing a first player to roll said pair of dice;

(b) allowing betting time for said other players to place bets on said first point or said second point;

(b) subsequent to said betting time, allowing said first player to roll said pair of dice;

(c) calculating a rolled total from the two numbers rolled on said pair of dice, said rolled total being the sum of the number on said first dice plus ten times the number on said second dice;

(d) calculating winners and losers on the turn through the steps comprising:

(i) if the rolled total equals or exceeds said target number, said first player wins and any players betting said first point win;

(ii) if the rolled total is less than said target number, players betting said second point win, and said first player and players betting said first point lose; and (iii) paying winning players an amount equivalent to their bet and taking the bets from losing players; and (iv) designating a new first player to roll once said first player's turn ceases and repeating steps b thru d.

2. The method of playing a game according to claim 1 further comprising the step of designating specific number pairs which if rolled by the first player render said first player an immediate winner and all of said other players immediate losers.

3. The method of playing a game according to claim 2 wherein said specific number pairs include 11, 22, 33, and 44.

4. The method of playing a game according to claim 1 further comprising allowing said first player to repeat their turn as said first player as many times as they wish before said new first player is chosen.

5. The method of playing a game according to claim 1 further comprising:

allowing players to place bets on one or a plurality of individual of said individual board numbers; and paying any player who bets one of said individual board numbers if the rolled total equals the chosen said individual board number, an amount equal to, or a multiple of, the amount bet on said individual board number.

6. The method of playing a game according to claim 2 further comprising:

allowing players to place bets on one or a plurality of individual of said individual board numbers; and paying any player who bets one of said individual board numbers if the rolled total equals the chosen said individual board number, an amount equal to, or a multiple of, the amount bet on said individual board number.

7. A method for playing a game using a designated target number and having a pair of dice, said pair of dice having first die with the numerals one through six and having a second die, with the numerals one through six, said second die visually identifiable from said first die, comprising:

(a) choosing a first player to roll said pair of dice;

(b) allowing betting time for said other players to place bets whether said first player will roll a number which is less than or exceeds said target number;

(c) subsequent to said betting time, allowing said first player to roll said pair of dice;

(d) calculating a rolled total from the two numbers rolled on said pair of dice, said rolled total being the sum of the number on said first dice plus ten times the number on said second dice;

(e) calculating winners and losers on the turn through the steps comprising:

(i) if the rolled total equals or exceeds said target number, said first player wins and any players betting that said roll by said first player would exceed said target number win;

(ii) if the rolled total is less than said target number, players betting that said roll by said first player would be less than said target number win, and said first player and players betting said roll would exceed said target number lose; and (iii) paying winning players an amount equivalent to their bet and taking the bets from losing players; and (iv) designating another first player to roll and repeating steps b thru d.

8. The method of playing a game according to claim 7 further comprising the step of designating specific number pairs which if rolled by the first player render said first player an immediate winner and all of said other players immediate losers.

9. The method of playing a game according to claim 8 wherein said specific number pairs include 11, 22, 33, and 44.

10. The method of playing a game according to claim 7 further comprising allowing said first player to repeat successive rolls as said first player as many times as they wish before said another first player is chosen.

11. The method of playing a game according to claim 1 further comprising:

said first player and said other players betting an item of clothing at each turn of said first player rolling said dice; and losing players having to remove said item of clothing.

12. The method of playing a game according to claim 2 further comprising:

said first player and said other players betting an item of clothing at each turn of said first player rolling said dice; and losing players having to remove said item of clothing.

13. The method of playing a game according to claim 3 further comprising:

said first player and said other players betting an item of clothing at each turn of said first player rolling said dice; and losing players having to remove said item of clothing.

14. The method of playing a game according to claim 7 further comprising:

said first player and said other players betting an item of clothing at each turn of said first player rolling said dice; and losing players having to remove said item of clothing.

15. The method of playing a game according to claim 8 further comprising:

said first player and said other players betting an item of clothing at each turn of said first player rolling said dice; and losing players having to remove said item of clothing.

16. The method of playing a game according to claim 11 further comprising:

choosing an order for turns by all players; and requiring that each player take their turn in said order.

17. The method of playing a game according to claim 11 further comprising:

all other players losing their respective item of clothing bet should the first player roll said target number exactly.

18. The method of playing a game according to claim 7 further comprising:

said first player and said other players betting an item of clothing at each turn of said first player rolling said dice; and losing players having to remove said item of clothing.

19. The method of playing a game according to claim 8 further comprising:

said first player and said other players betting an item of clothing at each turn of said first player rolling said dice; and losing players having to remove said item of clothing.

20. The method of playing a game according to claim 18 further comprising:

all other players losing their respective item of clothing bet, should the first player roll said target number exactly.

* * * * *